US007918651B2

(12) United States Patent
Jiang et al.

(10) Patent No.: US 7,918,651 B2
(45) Date of Patent: Apr. 5, 2011

(54) FAN AND IMPELLER THEREOF

(75) Inventors: Chen-Mo Jiang, Taoyuan Hsien (TW); Chung-Kai Lan, Taoyuan Hsien (TW); Hung-Chi Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 570 days.

(21) Appl. No.: 11/703,184

(22) Filed: Feb. 7, 2007

(65) Prior Publication Data

US 2008/0019824 A1 Jan. 24, 2008

(30) Foreign Application Priority Data

Jul. 21, 2006 (TW) ..... 95126649 A

(51) Int. Cl.
*F04D 29/24* (2006.01)
*F01D 5/22* (2006.01)

(52) U.S. Cl. ..... 416/203; 415/178; 415/187

(58) Field of Classification Search ..... 416/175, 416/178, 183, 187, 203
See application file for complete search history.

(56) References Cited

U.S. PATENT DOCUMENTS

| | | | | |
|---|---|---|---|---|
| 6,540,476 | B2 * | 4/2003 | Huang et al. | 415/98 |
| 6,866,481 | B2 * | 3/2005 | Chiang et al. | 416/178 |
| 6,908,287 | B2 * | 6/2005 | Cho et al. | 416/189 |
| 6,984,111 | B2 * | 1/2006 | Kitazume | 416/175 |
| 6,986,643 | B2 * | 1/2006 | Huang et al. | 416/183 |
| 2003/0143070 | A1 * | 7/2003 | Huang et al. | 415/206 |
| 2005/0169757 | A1 * | 8/2005 | Chen et al. | 416/179 |
| 2005/0191174 | A1 * | 9/2005 | Zeng et al. | 415/206 |
| 2006/0039783 | A1 * | 2/2006 | Horng et al. | 415/206 |
| 2008/0292464 | A1 * | 11/2008 | Keber et al. | 416/185 |

FOREIGN PATENT DOCUMENTS

DE 202004012015 * 12/2005

* cited by examiner

*Primary Examiner* — Ninh H Nguyen
*Assistant Examiner* — Jesse Prager
(74) *Attorney, Agent, or Firm* — Birch, Stewart, Kolasch & Birch, LLP

(57) ABSTRACT

An impeller includes a hub, a plurality of first blades, and a plurality of second blades. The first blades are disposed around the hub. The second blades are disposed between the first blades. The lengths of the second blades are shorter than those of the first blades. The impeller can avoid the airflow reflux and have good airflow efficiency.

16 Claims, 4 Drawing Sheets

FAN AND IMPELLER THEREOF

CROSS REFERENCE TO RELATED APPLICATIONS

This Non-provisional application claims priority under 35 U.S.C. §119(a) on Patent Application No(s). 095126649 filed in Taiwan, Republic of China on Jul. 21, 2006, the entire contents of which are hereby incorporated by reference.

BACKGROUND OF THE INVENTION

1. Field of Invention

The invention relates to a fan and an impeller thereof and, in particular, to a fan and an impeller, which have multiple sets of blades.

2. Related Art

Since the present electronic products are rapidly developed towards high performance, high frequency, high speed and more compact, the generated heat of the electronic products becomes greater. However, the electronic products may unstable in the high temperature so that the reliability thereof is affected. Thus, the heat dissipation has become an important issue of the present electronic products.

The fan is a common heat dissipating device for the electronic product. As shown in FIG. 1, a conventional impeller 10 mainly includes a plurality of blades 101 and a hub 102. The blades 101 are disposed around the hub 102. The hub 102 is used for accommodating a motor (not shown), which drives the impeller 10 to rotate.

Since the need for heat dissipation is larger, the performance of the fan must be higher. In general, for increasing the airflow quantity, the size of the blades 101 is enlarged and the thickness of the blades 101 becomes thinner. To maintain the strength of the large-sized blades 101, the prior art adopts metal blades or adds a circular ring 11 for strengthening the structure of the impeller 10. Herein, the circular ring 11 is disposed around the periphery of the blades 101.

The design of the blades 101 is to make the airflow field smoother. However, when the airflow flows through the impeller 10, it will be interfered by the circular ring 11, which leads to the poor efficiency of a part of the airflow near the circular ring 11. Furthermore, the airflow may be have reflux around the impeller 10, resulting in waste of the fan power.

Therefore, it is an important subject to provide a fan and an impeller thereof, which can avoid the airflow reflux and have good airflow efficiency.

SUMMARY OF THE INVENTION

In view of the foregoing, the object of the invention is to provide a fan and an impeller thereof with multiple sets of blades. The fan and impeller of the invention can avoid the airflow reflux.

To achieve the above object, the invention discloses an impeller including a hub, a plurality of first blades, at least one reinforcing element, and a plurality of second blades. The first blades are disposed around the hub. The reinforcing element connects with the first blades and the second blades. At least one second blade is disposed between any two adjacent first blades.

In addition, the invention also discloses a fan including an impeller and a motor. The impeller includes a hub, a plurality of first blades, at least one reinforcing element, and a plurality of second blades. The first blades are disposed around the hub. The reinforcing element connects with the first blades and the second blades. At least one second blade is disposed between any two adjacent first blades. The motor is disposed in the hub of the impeller and drives the impeller to rotate.

As mentioned above, the fan and impeller of the invention have multiple sets of blades. In practice, at least one second blade is disposed between two adjacent first blades, and the length of the second blade is shorter than that of the first blade. The second blades further connect with the reinforcing element or a base for enhancing the ability of doing work of the blades. Therefore, the airflow can be forced and outputted by the blades so as to avoid the airflow reflux, and thus provide good airflow efficiency.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
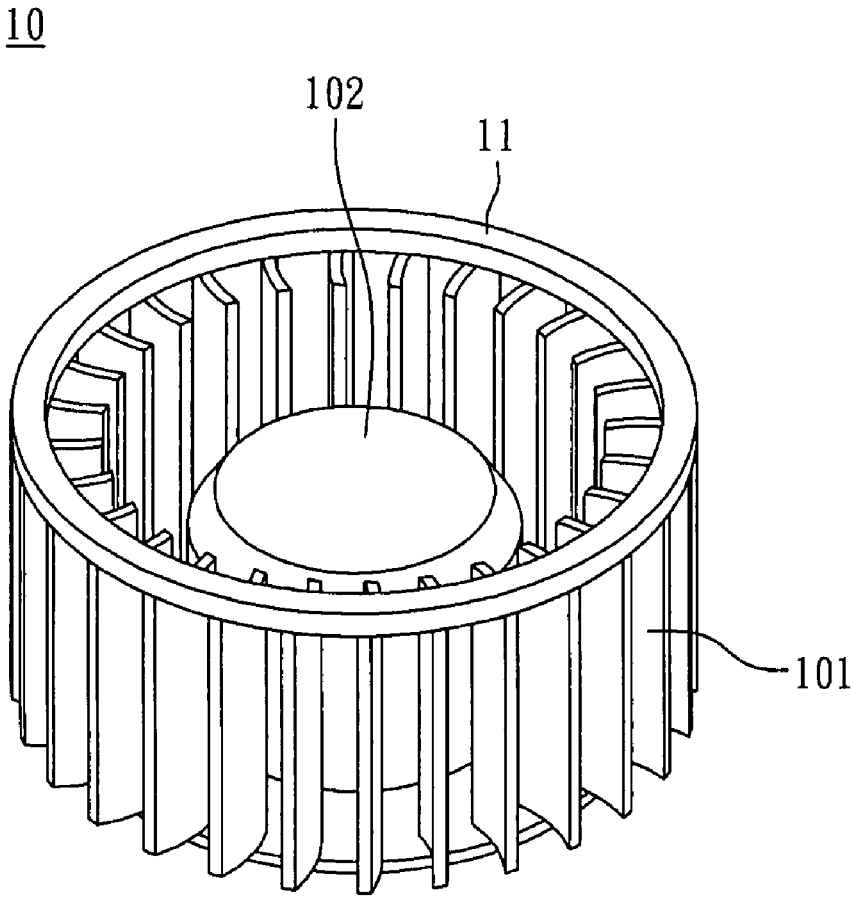
FIG. 1 (PRIOR ART)
FIG. 1 is a perspective view of a conventional impeller of a blower.
Figure 2:
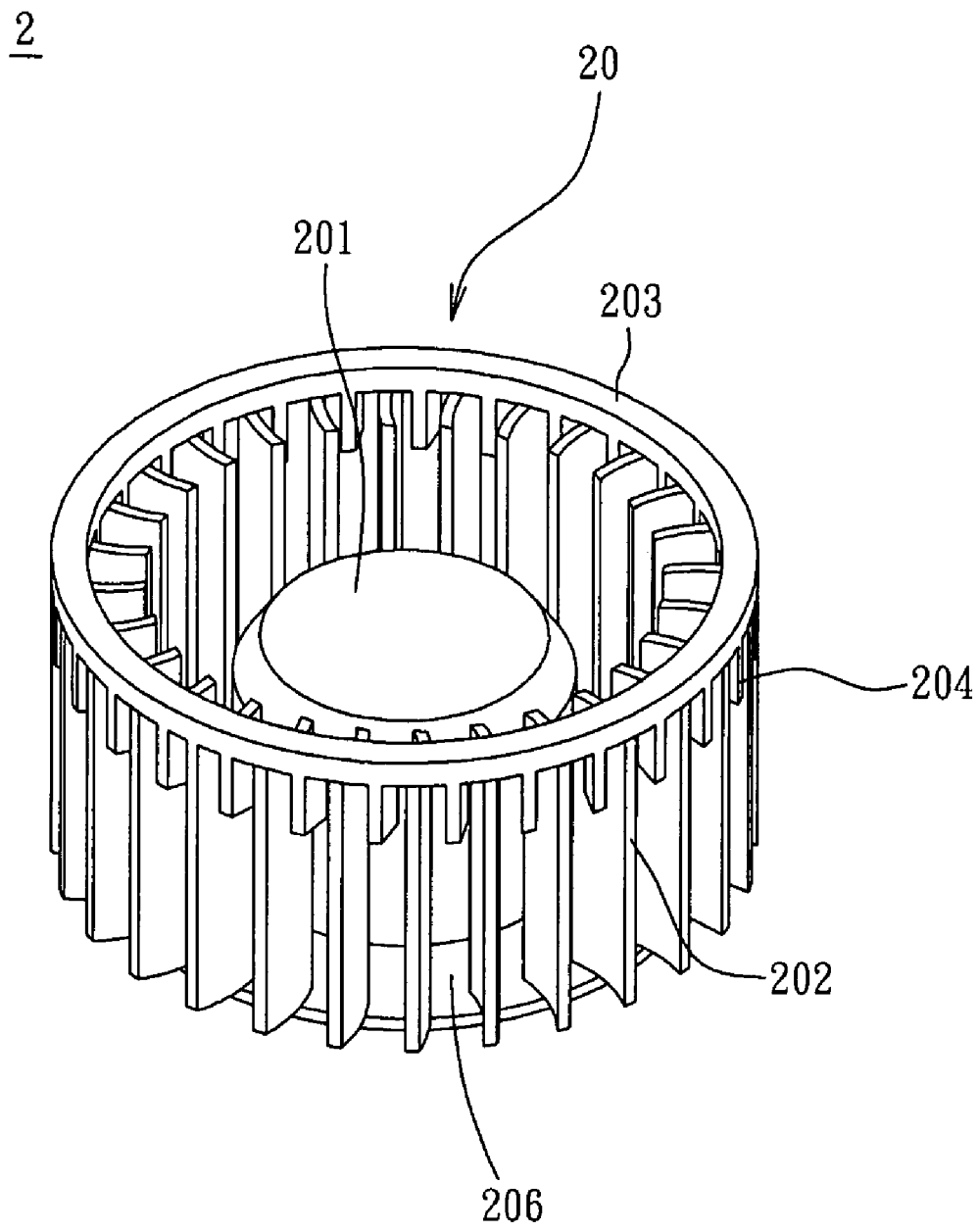
FIG. 2 and FIG. 3 are perspective views respectively showing different impellers according to the embodiments of the invention.

With reference to FIG. 2, a fan 2 according to an embodiment of the invention includes an impeller 20 and a motor. In this embodiment, the fan 2 is, for example, a blower.

The impeller 20 includes a hub 201, a plurality of first blades 202, at least one reinforcing element 203, and a plurality of second blades 204. The first blades 202 are disposed around the hub 201. In this embodiment, the first blades 202 and the hub 201 can be integrally formed as a single piece. The motor, which is accommodated in the hub 201, connects with the impeller 20 and drives it to rotate.

The reinforcing element 203 connects with the first blades 202 for strengthening the structure of the first blades 202. In the embodiment, the first blades 202 are made of plastic or metal. The first blades can be plate blades, forward leaning blades or backward leaning blades, and the cross sections thereof can be arc, rod-like, wing-shaped or wave-shaped. The reinforcing element 203 is ring-shaped.

The second blades 204 are disposed adjacent to the reinforcing element 203 and connected with the reinforcing element 203. In the embodiment, at least one second blade 204 is disposed between two adjacent first blades 202. Alternatively, the second blades 204 are disposed between the first blades 202 by a skipping way or by an irregular way. In details, the second blade(s) can be arranged between some of the first blades 202, and there is no second blade disposed between other first blades 202. The lengths of the second blades 204 are shorter than those of the first blades 202. Moreover, the lengths of the second blades 204 can be the same or not the same. The numbers of the second blades 204 disposed between the adjacent first blades can be the same or not the same. Alternatively, the second blades 204 can be disposed on a base 206 of the impeller 20.

In the embodiment, the second blades 204 and the reinforcing element 203 can be individual members and are assembled with each other. Alternatively, the second blades 204 and the reinforcing element 203 can be integrally formed as a single piece, and the second blades 204 are axially extended from the reinforcing element 203. The active surface of the second blade 204 is roughly parallel to that of the first blade 202. The distances between the second blade 204 and the first blade 202 adjacent to the second blade 204 are the same or not the same. In other words, the intervals between the first blades 202 and the second blades 204 are regularly or irregularly arranged.

Figure 3:
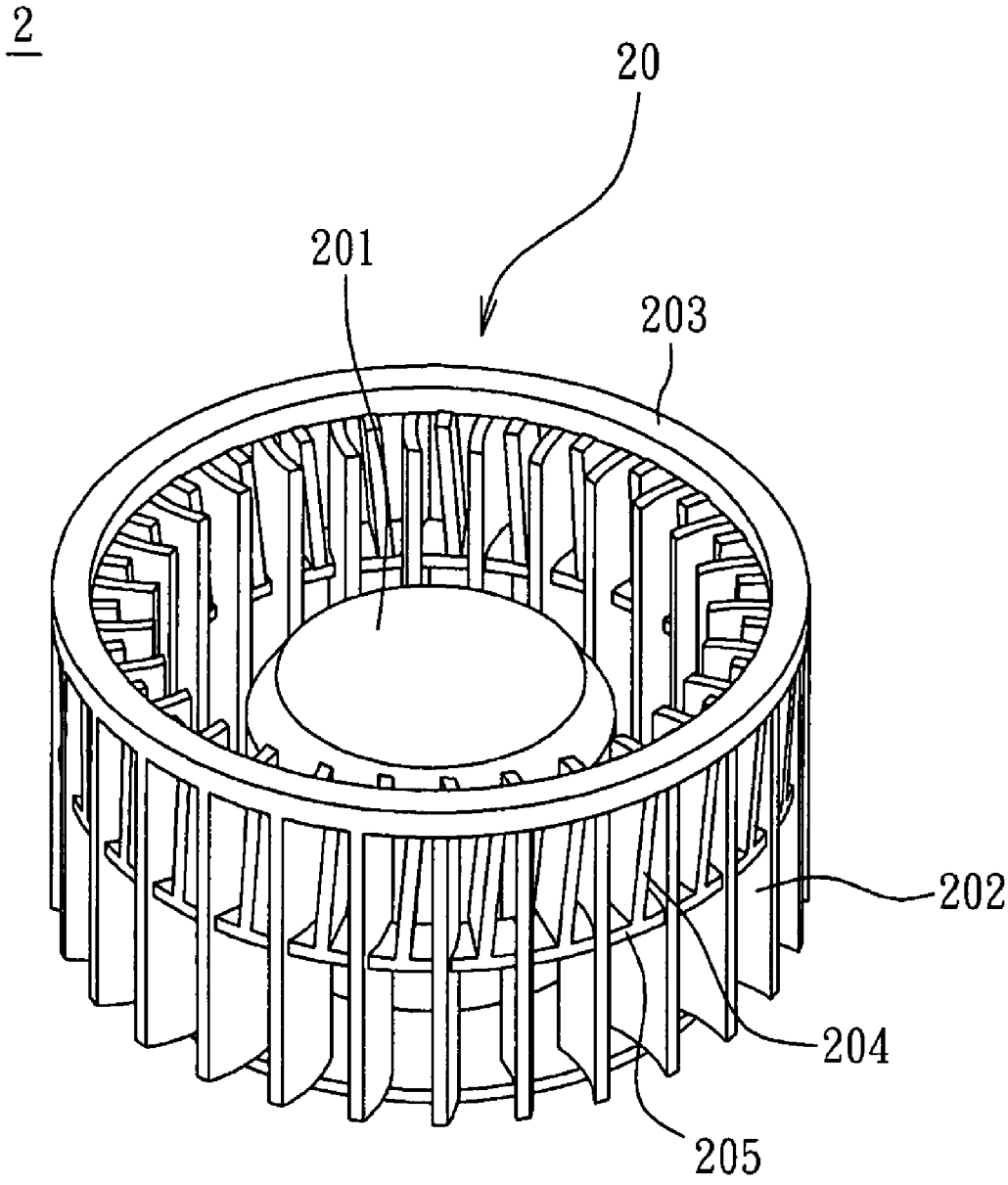

With reference to FIG. 3, the fan 2 of the embodiment, which is a blower, further includes a connecting element 205 disposed between two adjacent first blades 202 for further strengthening the structure of the impeller 20. Herein, the second blade 204, which is disposed between two adjacent first blades 202, connects with the connecting element 205. The usable material, type and cross section of second blade 204 are the same as those of the previous-mentioned first blade 202, so the detailed descriptions are omitted.

Figure 4:
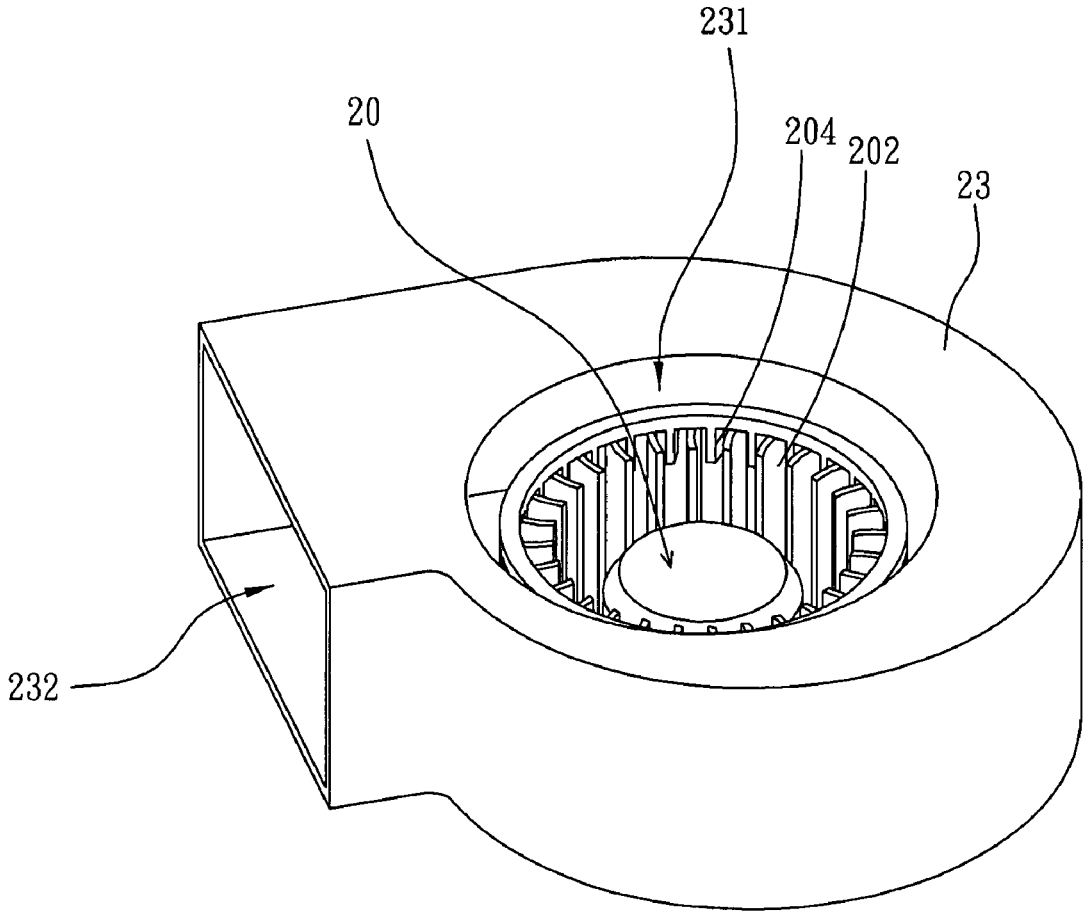
FIG. 4 is a perspective view showing a fan according to an embodiment of the invention.

With reference to FIG. 4, the fan 2 of the embodiment further includes a frame 23, which has at least one inlet 231 and at least one outlet 232. The impeller 20 is accommodated in the frame 23. When the impeller 20 rotates, an airflow is formed, which enters the frame 23 through the inlet 231 and leaves the frame 23 through the outlet 232.

In summary, the fan and impeller of the invention have multiple sets of blades. In practice, at least one second blade is disposed between two adjacent first blades, and the length of the second blade is shorter than that of the first blade. The second blades further connect with the reinforcing element or a base for enhancing the ability of doing work of the blades. Therefore, the airflow can be forced and outputted by the blades so as to avoid the airflow reflux, and thus provide good airflow efficiency.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An impeller comprising:

a hub;

a plurality of first blades disposed around the hub;

a plurality of second blades disposed between the first blades, wherein the lengths of the second blades are shorter than those of the first blades;

at least one reinforcing element connected with the first blades, wherein the second blades are connected with the reinforcing element and axially extend from the reinforcing element, wherein the first and second blades extend downwardly from the reinforcing element;

a base extending outwardly from a bottom of the hub, wherein the first blades are disposed on the base; and a connecting element disposed between two adjacent first blades, wherein the second blades are connected with the connecting element.

2. The impeller of claim 1, wherein the first blades and the second blades are made of plastic or metal.

3. The impeller of claim 1, wherein the first blades and the second blades have arc, rod-like, wing-shaped or wave-shaped cross-sections.

4. The impeller of claim 1, wherein the first blades or the second blades are plate blades, forward leaning blades or backward leaning blades.

5. The impeller of claim 1, wherein the reinforcing element is ring-shaped.

6. The impeller of claim 1, wherein the lengths of the second blades are not identical.

7. The impeller of claim 1, wherein numbers of the second blades disposed between any adjacent two of the first blades are the same or not the same.

8. The impeller of claim 1, wherein the second blades are disposed alternately with the first blades.

9. The impeller of claim 1, wherein at least one of the second blades is disposed between any adjacent two of the first blades.

10. The impeller of claim 1, wherein an active surface of the second blade is substantially parallel to that of the first blade.

11. The impeller of claim 1, wherein distances between the second blades and the first blades adjacent to the second blades are the same or not the same.

12. The impeller of claim 1, wherein the first blades are axially extended from the base.

13. A fan comprising:

an impeller comprising a hub, a plurality of first blades and a plurality of second blades, wherein the first blades are disposed around the hub, the second blades are disposed between the first blades, and the lengths of the second blades are shorter than those of the first blades;

a motor coupled to the impeller for driving the impeller;

at least one reinforcing element connected with the first blades and the second blades, wherein the first and second blades extend downwardly from the reinforcing element;

a base extending outwardly from a bottom of the hub, wherein the first blades are disposed on the base; and a connecting element disposed between two adjacent first blades, wherein the second blades are connected with the connecting element.

14. The fan of claim 13, wherein numbers of the second blades disposed between any adjacent two of the first blades are the same or not the same.

15. The fan of claim 13, wherein the second blades are disposed alternately with the first blades.

16. An impeller comprising:

a hub;

a reinforcing element;

a plurality of first blades, wherein each of the first blades has two ends, one end is connected to the hub and the other end is connected to the reinforcing element;

a plurality of second blades disposed between the first blades and connected to the reinforcing element, wherein the lengths of the second blades are shorter than those of the first blades;

a base extending outwardly from a bottom of the hub, wherein the first blades are disposed on the base; and a connecting element disposed between two adjacent first blades, wherein the second blades are connected with the connecting element.

* * * * *